United States Patent [19]

von den Benken et al.

[11] 3,952,427

[45] Apr. 27, 1976

[54] INSOLE FOR FOOTWEAR

[76] Inventors: Elisabeth von den Benken; Henry von den Benken, both of 2212 Centre St., West Roxbury, Mass. 02132

[22] Filed: May 9, 1974

[21] Appl. No.: 468,223

[52] U.S. Cl. ..... 36/103 WI; 36/43

[51] Int. Cl.[2] ..... A43B 00/00

[58] Field of Search ..... 36/43, 2.5 R; 12/128 C, 12/128 D, 145

[56] References Cited

UNITED STATES PATENTS

| | | | |
|---|---|---|---|
| 284,066 | 8/1883 | Rogers | 12/128 C |
| 969,691 | 9/1910 | Hemphill | 36/43 |
| 2,953,862 | 9/1960 | Majer | 36/43 |
| 3,601,908 | 8/1971 | Gilkerson | 36/43 |

*Primary Examiner*—Patrick D. Lawson

[57] ABSTRACT

This invention pertains to insoles and lasts for footwear. The insole has one or several protrusions which fit correspondingly disposed cavities in the outer sole thus assuring correct alignment of the outer sole and the insole at assembly. Lasting hooks are located around the insole which help to improve string-lasting and make possible a novel lasting method in conjunction with holes in the lasting margin of the upper. The last has two registration pins, one of them is firmly, the other one resiliently located in its bottom; they assure accurate positioning of the insole against the bottom of the last and eliminate the use of tacks.

2 Claims, 6 Drawing Figures

INSOLE FOR FOOTWEAR

BACKGROUND AND SUMMARY

This invention relates to insoles for footwear, to the adjacent outer sole and to shoe lasts which are needed in the manufacture of footwear. The insole has always been an important component of any good shoe. Decades ago, it was made from leather, but today the majority of all insoles are made from paper-based materials. Lately, some shoe manufacturers use insoles which are partially or wholly molded from plastic materials. It can be expected that molded insoles will be increasingly used in the near future in the same way that molded outer soles have been increasingly used in the past few years.

Recently, the outer sole and the heel of a shoe are molded as one piece and are well-known as unit soles. If made in large quantities, these unit soles are economically advantageous but, they are precision-made and therefore it is necessary that the adjacent components such as upper and insole are also precisely made prior to assembly. Correct alignment and matching is of utmost importace when assembling mass-produced components. For instance, great care must be taken when the outer sole is attached to the lasted shoe, i.e., it must be in correct alignment with the insole of the shoe. If molded shoe components are used at assembly, subsequent touch-up or finishing operations should not be necessary, otherwise some of the advantages of molded shoe components are lost. So then a shoe assembler has to have experience and skill as to position accurately the insole against the bottom of the last and the outer sole against the lasted shoe or insole respectively. But, even when the assembler has correctly positioned the outer sole to the lasted shoe, there is a chance that the outer sole might slip away from its predetermined position when the outer sole is joined to the shoe in the sole attaching press. This can happen when the cement is yet too slippery or when the shoe is improperly located on the sole pad. This problem will be eliminated when the insole has an aligning protrusion which fits a correspondingly disposed cavity in the outer sole assuring an accurate predetermined position at the assembly of the outer sole.

In conventional shoemaking the shank portion of an insole is often made stiff by attaching a steel shank to it. Usually, the steel shank is attached to the insole by means of staples. The stiffening effect can be accomplished by molding a reinforcement rip to the insole. Again, the operation of attaching the steel shank to the insole is hereby eliminated.

A rather new way of lasting shoes is string-lasting, so called because string is used to pull the lasting margin of an upper over the edge of an insole. In this method of lasting shoes, the string is slideably attached all around the edge of the shoe upper. When the upper is to be lasted over the last, the ends of the string are pulled, forcing the edge of the upper onto the bottom of the last. Due to the shape of a last, the maximum pulling force is applied to the upper at its toe and heel end where good lasting is accomplished. In order to accomplish proper lasting of the sides of the shoe as well, the operator pulls the upper over the sides by means of a pair of lasting pincers and drives a few staples to hold the lasting margin in place. However, by means of lasting hooks positioned on our novel insole it is possible to eliminate driven fasteners and improve the string lasting operation considerably. After the heel and toe have been properly lasted, but the sides of the upper only partially pulled over, the operator grabs the string by means of a special tool, pulls up the sides of the upper and fastens them by drawing the string behind the lasting hooks. This way, there is no danger that later on a metal fastener might get into the inside of the shoe.

In another novel lasting operation the lasting hooks are located all around the molded insole. When the upper is prepared for lasting, holes are punched through the lasting margin of the upper identical to the number of lasting hooks of the corresponding insole. The upper is pulled manually over the last and held in place by engaging the lasting margin through the holes to the lasting hooks. This method of lasting is suitable for soft fabric uppers or for those uppers which can be softened sufficiently prior to lasting. Though limited to inexpensive footwear, it eliminates the need of all costly lasting machinery.

For a long time it has been the desire of the shoe industry to attach the insole to the bottom of a last without using tacks or other metals fasteners, and prior art has taught several ways of doing so. But all suggestions seem to have some disadvantages since until now the majority of all insoles are attached to the last by tacks. It is believed that our improved last is a real breakthrough in tackless insole fastening. The improvement of a shoe last comprises two registration pins, one of them firmly located in the forepart area of the last, the other one resiliently located in the heel area of the last. The ends of the registration pins stick out of the bottom of the last and engage their corresponding registration holes in the insole. When the insole is attached to the last, it is first pushed onto the resilient registration pin in the heel end of the last, then moved forward toward the toe end overcoming the force of resiliency, and finally slipped onto the registration pin in the forepart area of the last. Now, the insole is firmly held in place since the force of the compressed spring keeps the insole under tension, and the conically shaped ends of the pins prevent any slippage of the insole away from the last bottom.

It is an objective of this invention to minimize the skill of the sole attaching operator who is responsible for the accurate positioning of the outer sole relative to the insole. This is accomplished by molded aligning protrusions on the insole which fit correspondingly disposed cavities in the outer sole. At assembly, these aligning protrusions will guide the outer sole into its predetermined, correct position.

It is another objective of this invention to manufacture an insole which receives in one molding operation some or all of those features which are pointed out in this specification, i.e. aligning protrusions, registration holes, shank reinforcement rib, lasting hooks, arch support, and a contour which fits the contour of the bottom of the last. This way it is possible to eliminate several individual operations and keep the manufacturing costs down.

It is a further objective of this invention to improve the method of string-lasting. In this lasting method there are hardly any forces available to pull-over the sides of a shoe upper by a string. After the sides of the upper have been pulled over manually, the lasting margin of the upper can be held in place by the engagement of the lasting hooks and the string which is slideably attached to the lasting margin.

Another aim of this invention is the development of a new lasting method. This lasting method will be particularly suitable for fabric uppers or other soft uppers. When using this method of lasting, lasting hooks are located all around the insole and the upper is prepared in such a way that its lasting margin has a plurality of holes which in number and location correspond to the lasting hooks of the insole. At assembly, the upper is pulled over by manual lasting pincers and connected to the insole by tying it through the holes behind the lasting hooks. Of course, insole and upper can be precemented in any conventional way.

It is another aim of this invention to ease the locating and attaching of the insole to the bottom of a last without using tacks or other driven fasteners. The last bottom is equipped with two registration pins, one firmly located in the toe area, the other one resiliently located in the heel area. The insole has two corresponding registration holes. When the insole is attached to the last, it is first pushed onto the resilient pin in the heel area, then moved toward the toe against a spring force until the toe hole engages the pin in the toe area.

The above and other features of this invention will now be described in more detail with reference to the accompanying drawings. It is to be understood that the particular embodiments referred to above and herein described are deliniated for illustration of the invention only and are not to be construed as limiting the scope thereof.

DESCRIPTION OF THE PREFERRED EMBODIMENT

Figure 1:
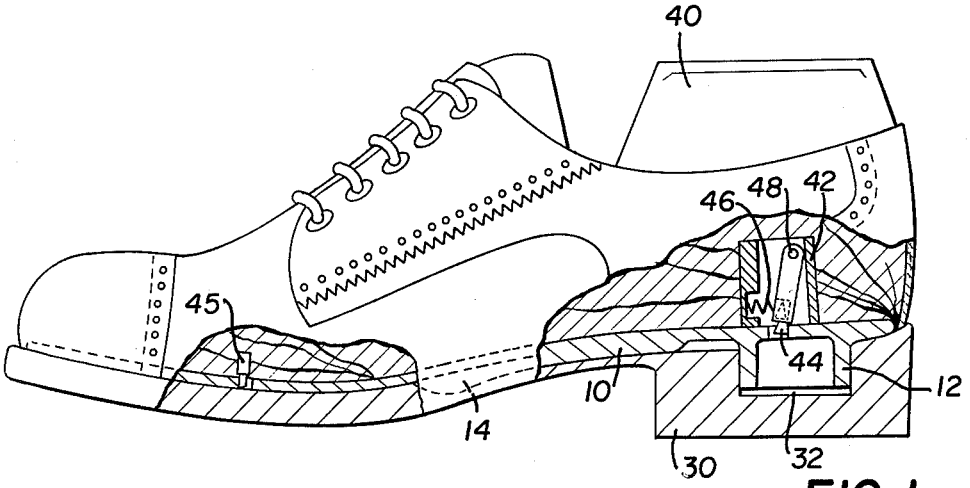
FIG. 1 is a side view of a shoe assembled on a last, showing by cut-aways certain aspects of the invention.
Figure 2:
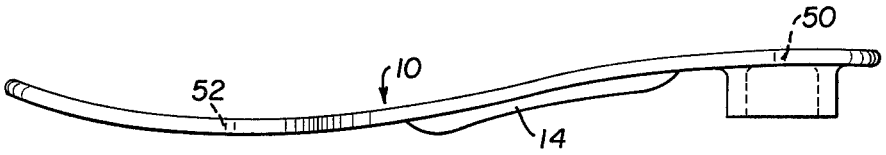
FIG. 2 is a side view of the insole as used in the assembled shoe of FIG. 1.
Figure 3:
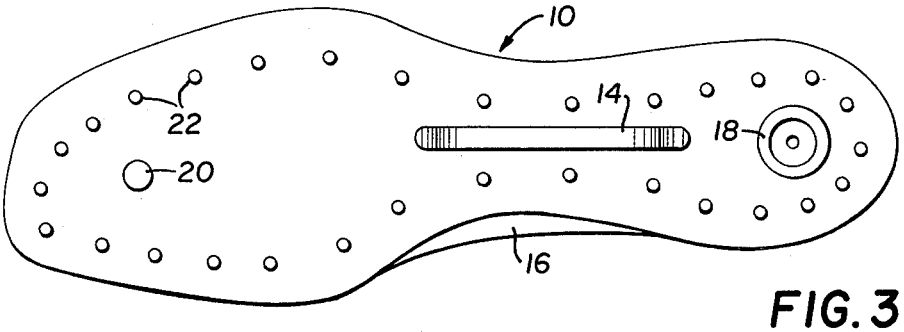
FIG. 3 is a plan view of an insole showing additional features of this invention.
Figure 4:
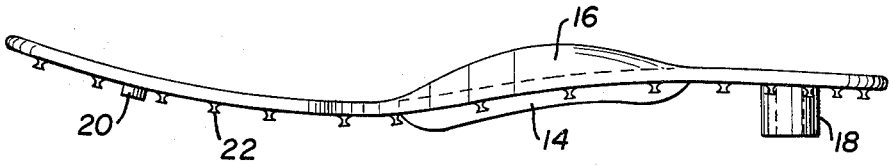
FIG. 4 is a side view of the insole in FIG. 3.

The illustrative insole 10 as shown in FIG. 1 and FIG. 2 has a protrusion 12 which fits snugly in the cavity 32 of the outer sole 30 thus assuring correct alignment of the outer sole 30 against the bottom of the lasted shoe. The protrusion 12 can have various shapes and will not only serve as an alignment pin, but will also favorably effect the stability and rigidity of the heel of the outer sole 30. It is very well possible to cement the protrusion 12 in the cavity of the outer sole so that a separation of the heel and the insole 10 becomes almost impossible. The insole 10 in FIGs. 1 to 4 has a shank reinforcement rib 14 which is integrally molded to the insole. The insole 10 is molded in such a way that the reinforcement rib 14 does not have any sharp corners or notches, thus avoiding stress concentrations when the shoe is worn. As revealed in FIG. 1 the outer sole 30 has a clearance cavity for reinforcement rib 14. Said clearance cavity could be made small enough to serve as an additional alignment means when the outer sole is assembled to the shoe. In FIGS. 3 and 4 is shown arch support 16 which is also integrally molded to the insole in one molding operation. Normally, an arch support improves the comfort of a shoe, but in order to economize it is often eliminated. If molded together with the insole in one operation, the arch support does not entail any cost except for the few grams of additional material.

Figure 5:
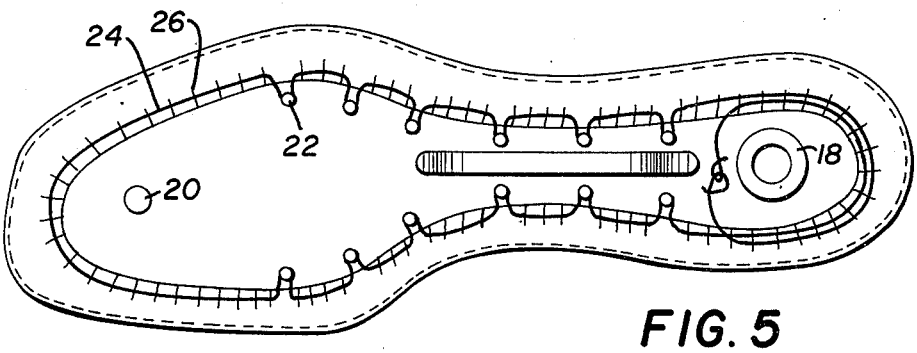
FIG. 5 is a plan view of the bottom of a shoe which has been string-lasted in conjunction with the lasting hooks of our novel insole.

The insole 10 in FIGS. 3 to 6 is equipped with aligning protrusion 18 located in the heel area, and protrusion 20 located in the toe area. Of course, they need corresponding cavities in the outer sole and serve the same purpose as described before with reference to protrusion 12. Also, the insole 10 as shown in FIGS. 3 to 6 is characterized by a plurality of lasting hooks 22 which are normally molded together with the insole in one operation. The lasting hooks 22 must be strong enough to hold the pulled-over upper in place. They are located along the edge of the insole about one-fourth to 1 inch away from the edge. The ends of the lasting hooks 22 have slight rims which prevent the string 24 or the engaged upper from slipping off. The purpose and function of the lasting hooks 22 will be explained with reference to FIG. 5 and FIG. 6. In FIG. 5 is shown string 24 which is loosely and slideably attached to the edge of an upper by means of stitches 26. At the heel end the string 24 is doubled so that both ends of the string can be pulled into the same direction when string-lasting is to be accomplished. When string-lasting, the greater part of the pulling-over force is applied to the toe and heel end of a shoe. One can easily visualize that a string, when tensioned around the shoe, cannot pull the upper over the sides of insole 10. In present-day manufacture, the operator pulls the sides of the upper manually and keeps them in place with a few driven fasteners. According to our invention the operator grips the string by means of a special tool, pulls the sides of the shoe upper over the insole and pushes the string 24 behind the lasting hooks 22 thus fastening the upper to the insole 10. If upper and insole are precemented, only slight pressure will be needed for good bonding of the same.

Figure 6:
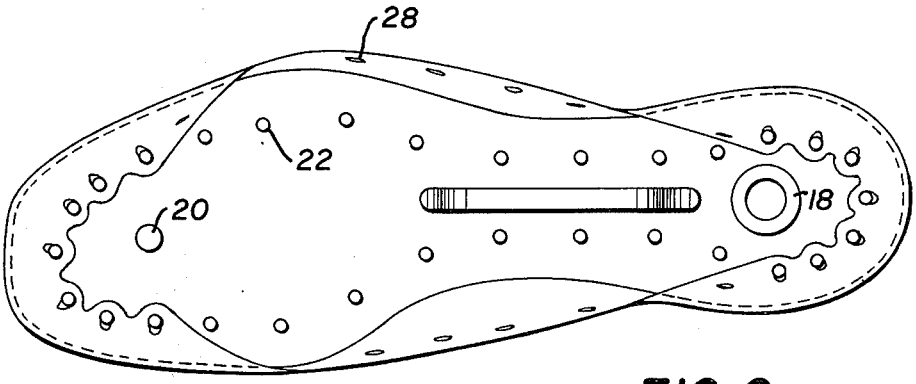
FIG. 6 is a plan view of the bottom of a shoe which has been partially lasted according to our novel lasting method.

Another novel lasting method using lasting hooks 22 is explained with reference to FIG. 6. In preparation for this lasting method holes 28 or similar perforations are punched through the lasting margin of the upper, the number of perforations being identical with the number of lasting hooks 22 of the corresponding insole. It should be assumed that the insole 10 is attached to the bottom of the last and that cement has been applied to the upper and the insole. First, the operator engages three holes of the heel end with three corresponding lasting hooks of the insole. Then, he tensions the upper over the toe end of the last, using lasting pincers, until he can engage the hole with related lasting hooks 22 of the insole. After the toe and heel end of the upper have been secured to the insole, the sides are pulled over and kept in place by the engagement of the holes and the lasting hooks. It is obvious that no lasting machinery is needed for this kind of lasting. Shoe uppers made of soft materials are particularly suitable for this lasting method.

The last 40 in FIG. 1 shows improved holding means by which the operator can attach the insole 10 to the bottom of the last without using tacks or other driven fasteners. In the heel end of the last 40 is located a housing 42. In housing 42 is pivotally positioned registration pin 44, on which compression spring 46 applies pressure constantly. Pin 48 holds the registration pin 44 in the housing 42 but allows for a pivoting movement.

Registration pin 45 is firmly located in the forepart of the last 40. The ends of pin 44 and 45 are conically shaped to prevent the insole from slipping off the pin once the insole is attached against the bottom of the last. The insole 10 has two registration holes 50 and 52, FIG. 2, which must be so located that the insole properly matches the bottom of the last when the holes engage the registration pins 44 and 45. When the operator attaches the insole to the last, he first engages registration hole 50 with the resiliently located registration pin 44, then he moves the insole and the registration pin in unison toward the firmly located registration pin 45 until registration hole 52 slips over said pin. If the entire insole is made by a molding or casting process, holes 50 and 52 should be made simultaneously by the same process. However, if the insole is partially molded or cut out of a board, said registration holes can be punched into it. Also, it is possible that the resilient registration pin and the firmly located registration pin switch their position in the last, i.e. either pin could be located in either end of the last.

It should be kept in mind that several variations of the insole described before are possible without deviating from the scope of this invention. For instance, it might be desireable to have the lasting hooks 22 positioned at the sides of the insole, using them for side lasting only, while the heel and toe are lasted by a conventional heel lasting and toe lasting machine. This could be necessary when stiffeners in the heel and the toe of the upper make string lasting impossible.

Another practical use of lasting hooks has been found in conjunction with all-around lasting by means of a roller-type side lasting machine. In this case, the lasting hooks are used to position the perforated upper on the last. In doing so, the operation of all-around lasting is made considerably easier since the upper does not have to be held manually while last and upper are guided along the feed rolls of the side lasting machine.

Having thus described our invention, what we claim as new and desire to secure by Letters Patent of the United States is:

1. An insole for footwear having a molded shank reinforcement rib for which a clearance cavity is provided in a corresponding outer sole and a molded aligning protrusion located in its heel area pointing toward the outer sole of a shoe and being shaped so as to fit a cavity in a corresponding outer sole thereby assuring correct alignment of outer sole and insole, and a plurality of molded lasting hooks located along its edge pointing toward the outer sole and being so shaped that an upper will not slip off when it is tied to said lasting hooks.

2. A shoe comprising a molded insole with an alignment protrusion located in its heel area and a plurality of lasting hooks located along its edge, a molded outer sole with a cavity which fits the alignment protrusion of the insole thus assuring a correct location of the outer sole when it is assembled to the shoe, and a shoe upper having holes in its lasting margin whereby said upper can be tied to the lasting hooks when it is pulled-over at the lasting operation.

* * * * *